United States Patent [19]

Willi et al.

[11] 4,418,624

[45] Dec. 6, 1983

[54] AERODYNAMIC BRAKING ARRANGEMENT FOR PROJECTILE COMPONENTS WHICH ARE TO BE SALVAGED

[75] Inventors: Rauschert Willi, Altensitten; Bock Erich; Rieger Gerald, both of Nuremberg, all of Fed. Rep. of Germany

[73] Assignee: Diehl GmbH & Co., Nuremberg, Fed. Rep. of Germany

[21] Appl. No.: 288,475

[22] Filed: Jul. 30, 1981

[30] Foreign Application Priority Data

Aug. 7, 1980 [DE] Fed. Rep. of Germany ..... 3029914

[51] Int. Cl.[3] ..... F42B 5/26

[52] U.S. Cl. ..... 102/473; 102/340; 102/351; 102/357; 102/386; 102/498; 102/529

[58] Field of Search ..... 102/498, 502, 529, 513, 102/275.7, 386, 387, 388, 444, 340, 342, 351, 357, 473

[56] References Cited

U.S. PATENT DOCUMENTS

| | | | |
|---|---|---|---|
| 1,340,259 | 5/1920 | Taylor | 102/342 X |
| 2,373,364 | 4/1945 | Wellcome | 102/504 |
| 2,900,907 | 8/1959 | Kempton et al. | 102/504 |
| 3,049,080 | 8/1962 | Schermuly | 102/351 X |
| 3,105,438 | 10/1963 | Aberg | 102/351 X |
| 3,604,667 | 9/1971 | de Moraes | 102/386 X |
| 3,797,395 | 3/1974 | Tyroler | 102/354 X |
| 3,834,312 | 9/1974 | Simmons | 102/342 X |
| 4,294,172 | 10/1981 | Rauschert et al. | 102/513 X |

FOREIGN PATENT DOCUMENTS

| | | |
|---|---|---|
| 2824203 | 12/1979 | Fed. Rep. of Germany . |
| 1459354 | 10/1965 | France . |

*Primary Examiner*—Peter A. Nelson

*Attorney, Agent, or Firm*—Scully, Scott, Murphy & Presser

[57] ABSTRACT

An aerodynamic braking arrangement for projectile components which are to be salvaged, such as detonators, consisting of a drag parachute having a high air-resistance index and of cables which connect the projectile components with the parachute. The drag chute is formed as a brake basket which consists of two cup-shaped tops at the ends thereof constituted of metal or plastic material, which are separated from each other along the axial direction of the projectile through the intermediary of at least one space formed of metal or plastic material, wherein the cables are fastened to one of the tops.

12 Claims, 4 Drawing Figures

AERODYNAMIC BRAKING ARRANGEMENT FOR PROJECTILE COMPONENTS WHICH ARE TO BE SALVAGED

BACKGROUND OF THE INVENTION

1. Field of the Invention

The present invention relates to an aerodynamic braking arrangement for projectile components which are to be salvaged, such as detonators, consisting of a drag parachute having a high air-resistance index and of cables which connect the projectile components with the parachute.

2. Discussion of the Prior Art

It has become known from German Laid-open patent application No. 28 24 203 for the detonators of projectiles which are to be salvaged, to expel the detonator from the fired projectile, together with a brake band or a drag parachute through the intermediary of an ejection charge and a piston, wherein the brake band is fastened to the detonator.

In projectiles of smaller and intermediate sized caliber and at projectile velocities which are higher than 700 meters per second, textile braking and salvaging devices, such as brake bands are not too effective since the braking action is relatively low. This disadvantage can be avoided in that there are employed so called multi-stage systems of brake bands or drag chutes. In small and intermediate sized projectile calibers, the space available within the projectile, however, is inadequate for the building-in of such complex and voluminous systems.

SUMMARY OF THE INVENTION

Accordingly, it is an object of the present invention to contemplate the provision of a braking arrangement which can be located within a small space and which is highly effective.

The foregoing object is obtained by means of a chute formed as a brake basket which consists of two cup-shaped tops at the ends thereof constituted of metal or plastic material, which are separated from each other along the axial direction of the projectile through the intermediary of at least one spacer formed of metal or plastic material, wherein the cables are fastened to one of the tops. Consequently, for a 35 mm projectile, an ejection time for the detonator set at about 0.25 seconds after firing, and for a muzzle velocity of about 1100 meters per second, the undamaged detonator will be found approximately 500 meters in front of the weapon.

In accordance with further features of the invention there is provided that the cables will withstand the cutting and chafing action of the metal components during ejection and during the braking.

Furthermore, the invention also provides for a symmetrical loading of the detonator which is to be braked during free flight, as well as for the brake basket.

Further features of the invention may be ascertained in the simplification of the manufacture for the braking arrangement, and in rendering easier the locating of the detonator.

It is also important for the invention that the brake basket which is connected with the detonator be formed of suitably shaped tops or containers evidencing a high air resistance.

BRIEF DESCRIPTION OF THE DRAWINGS

Reference may now be had to the following detailed description of an exemplary embodiment of the invention, taken in conjunction with the accompanying drawings; in which.

DETAILED DESCRIPTION

Figure 1:
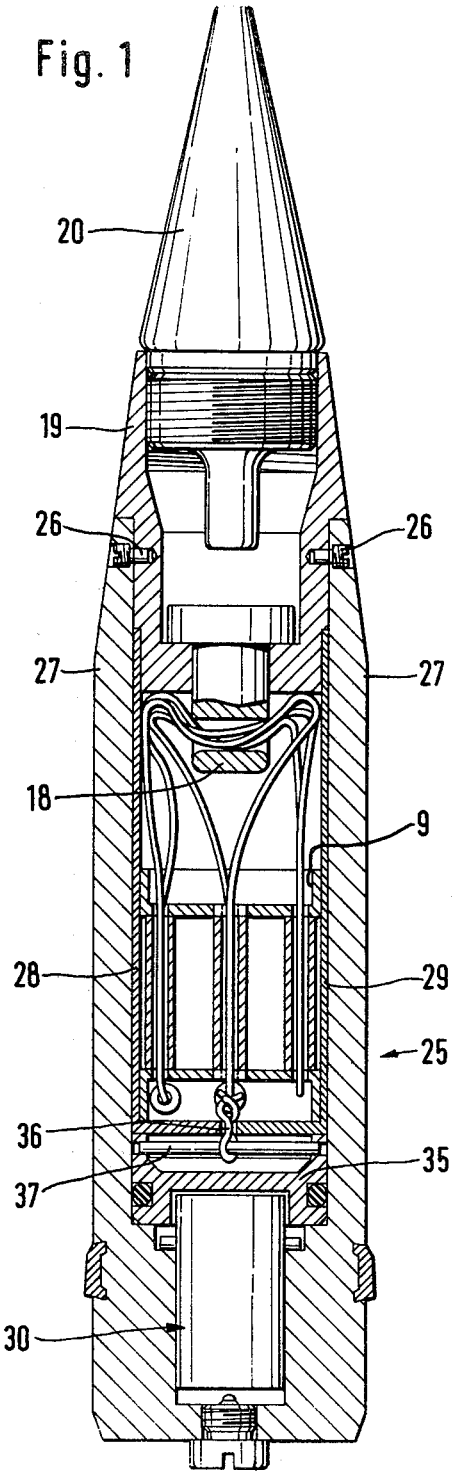
FIG. 1 illustrates an inventive braking arrangement arranged within a projectile.
Figure 2:
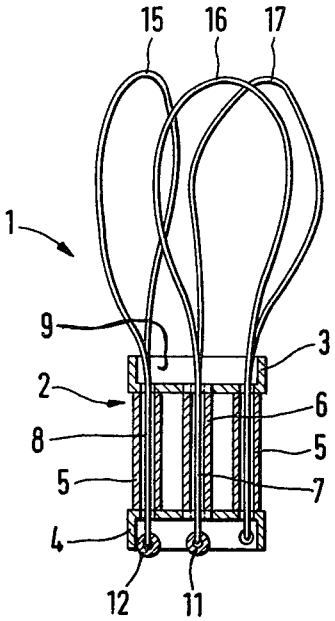
FIG. 2 illustrates the details of the braking arrangement constructed pursuant to FIG. 1.
Figure 3:
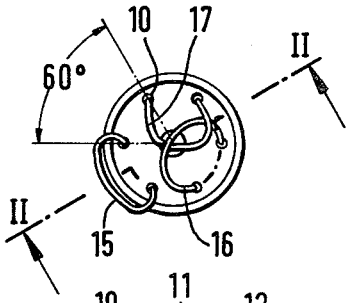
FIG. 3 illustrates a top plan view of the braking arrangement of FIG. 2.
Figure 4:
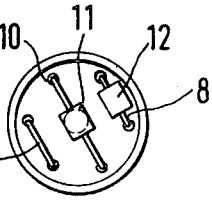
FIG. 4 illustrates a bottom plan view of the braking arrangement.

Referring now in detail to the drawings of the invention, the braking arrangement 1 consists of a brake basket 2, which is assembled of two similar, perforated aluminum cup-shaped tops 3,4, of aluminum spacer tubes 5, at the sides of the rims of the tops, an aluminum central tube 6, as well as steel cables 7, 8 which are interconnected at the bottoms.

The tops 3, 4 incorporate bores 10 in their cup bottoms along the rims at a distribution spacing of 60°. The opening 9 of the cup-shaped top 3 is oriented towards the detonator 20, or towards a mounting sleeve 19.

The three loops 15, 16, 17 consist of the two steel wire cables 7,8 which are interconnected in the region of the top 4 at the bottom side through pressure clamps 12, 11 which are formed of copper.

The steel cables 7, 8 are conducted through a swivel bolt 18 in the mounting sleeve 19, the tops 3, 4 and the spacer tube 5. The cables 7, 8 act in the manner of carrying belts. The cables evidence the required physical strength, are adapted to be located within a small space due to their bending ability and facilitates that the brake basket 2 will unfold its braking action at an optimum distance from the mounting sleeve 19. The mounting sleeve 19 fastens the actual detonator 20 within the projectile 24. The mounting sleeve 19 is connected through shear pins 26 with a projectile casing 27. Within this projectile casing 27, two half-shells 28, 29 support the above-described brake basket 2, and partly the previously mentioned mounting sleeve 19. In addition, supported in the projectile casing 27 is a piston 35 which is displaceable through the action of a pyrotechnic ejection device 30. The brake head 2 is coupled with the piston 35 by means of a further steel cable 36. For this purpose the steel cable 36 interconnects the cup-shaped top 4 and a pin 37 towards the side of the piston.

The brake basket 2 is painted with a daylight luminescent color, as well as is the detonator 20 and suitable portions of the mounting sleeve 19.

After the firing of the projectile 25 and the detonation of the ejection arrangement 30, the piston 35, upon the separation of the shear pins 26, drives the half-shells 28, 29 together with the mounting sleeve 19 and the detonator 20, out of the projectile casing 27.

The half-shells 28, 29, due to the lack of an interconnection, will fall away from the mounting sleeve 19 due to spinning action, so that the brake basket 2 with the loops 15, 16, 17 will move into the air stream.

Due to the high air resistance, the brake basket 2, at the most effective distance from the mounting sleeve 19 which has been experimentally determined, will stabilize the mounting sleeve 19 with the detonator 20, and effect an extremely short ballistic trajectory.

The shock of the impact of the detonator 20 against ground is smaller than the traveling shock of the projectile 29 within the weapon so that the integrity of the detonator 20 is afforded even for externally located plastic material components.

In lieu of the steel cables 7, 8 there can be also utilized high-strength plastic material cables, or cables formed of a metal, such as brass.

The number of the loops 15, 16, 17 can be increased or reduced in accordance with need. Significant to the number is the admissible loading of the cables.

We claim:

1. In an aerodynamic braking arrangement for projectile components which are to be salvaged, such as detonators; including a drag parachute havng a high air-resistance index; and cables interconnecting said projectile components with said drag parachute; the improvement comprising: said drag parachute being a brake basket having two cup-shaped tops at the ends thereof; at least one spacer separating said tops along the axial direction of said projectile, said cables being fastened to one of said tops.

2. Arrangement as claimed in claim 1, said cup-shaped tops being formed of metal.

3. Arrangement as claimed in claim 1, said cup-shaped tops being formed of plastic material.

4. Arrangement as claimed in claim 1, said spacer being formed of metal.

5. Arrangement as claimed in claim 1, said spacer being formed of plastic material.

6. Arrangement as claimed in claim 1, wherein the opening of the cup-shaped top at the end proximate said detonator faces towards said detonator.

7. Arrangement as claimed in claim 1, said cables being formed of steel wire.

8. Arrangement as claimed in claim 1, wherein said cables include three loops for fastening to said projectile component, said loops being conducted through bores adjacent the rims of said tops at 60° annular spacings and through said spacer, and having the free cable ends interconnected.

9. Arrangement as claimed in claim 8, said projectile component comprising a mounting sleeve.

10. Arrangement as claimed in claim 8, comprising pressure clamps interconnecting the free ends of said cables.

11. Arrangement as claimed in claim 1, said cup-shaped tops being of substantially similar configuration.

12. Arrangement as claimed in claim 1, wherein at least portions of said brake basket are covered with daylight luminescent color.

* * * * *